US005727470A

United States Patent [19]

Kurzer et al.

[11] Patent Number: 5,727,470

[45] Date of Patent: Mar. 17, 1998

[54] METHOD AND APPARATUS FOR CONTROLLING A WASHING OPERATION IN A PRINTING PRESS

[75] Inventors: Thomas Kurzer, Eppelheim; Johannes Springer, Heidelberg; Dieter Baecker, Sandhausen, all of Germany

[73] Assignee: Heidelberger Druckmaschinen AG, Heidelberg, Germany

[21] Appl. No.: 564,415

[22] Filed: Nov. 29, 1995

[30] Foreign Application Priority Data

Nov. 29, 1994 [DE] Germany ..... 44 42 412.4

[51] Int. Cl.[6] ..... B41F 35/00

[52] U.S. Cl. ..... 101/425; 101/423

[58] Field of Search ..... 101/425, 423, 101/424

[56] References Cited

U.S. PATENT DOCUMENTS

| | | | |
|---|---|---|---|
| 4,986,182 | 1/1991 | Sawaguchi et al. | 101/483 |
| 5,105,740 | 4/1992 | Loos et al. | 101/425 |
| 5,150,653 | 9/1992 | Hara | 101/425 |
| 5,178,070 | 1/1993 | Zorn et al. | 400/154.4 |
| 5,209,587 | 5/1993 | Herbert et al. | 400/225 |
| 5,275,104 | 1/1994 | Corrado et al. | 101/425 |
| 5,479,857 | 1/1996 | Braun | 101/423 |

FOREIGN PATENT DOCUMENTS

| | | |
|---|---|---|
| 0520521 | 12/1992 | European Pat. Off. . |
| 3841260 | 3/1990 | Germany . |
| 3909119 | 9/1990 | Germany . |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Printing press cylinders are washed with a washcloth which is selectively wound forward and backward between a rotatable supply drum and a rotatable takeup drum. The washcloth is thereby cyclically pressed against a surface of a respective cylinder of the printing press in the washing operation and it is transported onward onto the takeup drum. The washing operation is controlled by detecting, with a sensor system, a transport distance of the washcloth and furnishing, with the sensor, a transport distance signal. The system is initialized by checking whether or not the insert is present and/or whether or not the insert carries enough fresh washcloth. This is done by winding the washcloth forward and back by a given distance. During the ongoing washing operation the transport speed of the washcloth is continously determined from the transport distance signal and comparing with a predetermined lower value and a predetermined upper value. When these thresholds are met or exceeded, the washing operation is terminated or the printing press is stopped.

10 Claims, 5 Drawing Sheets

METHOD AND APPARATUS FOR CONTROLLING A WASHING OPERATION IN A PRINTING PRESS

BACKGROUND OF THE INVENTION

1. Field of the Invention

The invention relates to a method for controlling a washing operation in a printing press, in which a washcloth that can be wound forward and backward between two rotatable drums is pressed cyclically against the surface of a cylinder to be washed and is transported onward, the transport distance of the washcloth being detected by a sensor device which furnishes a transport distance signal. The invention also relates to a corresponding apparatus for performing the method.

2. Description of the Related Art

One such method and a corresponding apparatus are known from European Patent Disclosure EP 0 520 521 A1. As described therein, the wash cloth, which is transported forward during a washing cycle, is automatically transported back some distance after each cycle, so that its less-soiled rear portion can be used for the following cycle. In order to attain defined transport distances, the transport distance of the washcloth in the forward and backward direction is detected by a sensor device having a rubber wheel that rolls along the washcloth.

As automation of the washing mode improved, further functions have also been attained. Heidelberger Druckmaschinen AG of Germany, for instance, has constructed an replaceable washing insert which includes a sensor device, in the form of an indexing shaft, along which the washcloth rolls, and a sensor secured to the printing press; the sensor scans a toothed indexing wheel connected to the indexing shaft, and the thickness of the clean cloth roll is also scanned by a lug pressed resiliently against it, which cooperates mechanically with a second sensor on the machine. If there is no insert, or if the washcloth has been used up, the second sensor deactivates the washing program, and the printing press operator is shown the display "change washcloth" or "no insert present".

However, it has been found that the end of the washcloth, which is wound up in many layers, can be determined only highly inaccurately with the prior art apparatus and methods, and hence a remnant that is often enough for several wash cycles still remains unused. Moreover, the mechanics required for triggering the second sensor are often relatively complex and vulnerable to malfunction, since they are made up of many individual parts.

SUMMARY OF THE INVENTION

It is accordingly an object of the invention to provide a method and an apparatus for controlling a washing operation in a printing press, which overcomes the above-mentioned disadvantages of the prior art devices and methods of this general type. The main object of the invention is to realize a simpler, more accurate, more reliable and more versatile automatic wash control.

With the foregoing and other objects in view there is provided, in accordance with the invention, a method for controlling a washing operation in a printing press, wherein a washcloth is selectively wound forward and backward between a rotatable supply drum and a rotatable takeup drum, the washcloth is cyclically pressed against a surface of a cylinder of the printing press in the washing operation and is transported onward onto the takeup drum, the method which comprises:

detecting, with a sensor device, a transport distance of the washcloth device and furnishing, with the sensor, a transport distance signal;

in an initialization before a beginning of the washing operation: winding the washcloth forward and back by a given distance, and selectively outputting a ready signal if transport distance signals have been received from the sensor device or outputting a not-ready signal if transport distance signals have not been received from the sensor device as a result of the winding step; and in an ongoing washing operation:

continuously determining a transport speed of the washcloth from the transport distance signal;

continuously comparing the transport speed with a predetermined lower value and a predetermined upper value; and outputting an end-of-washcloth signal if the transport speed reaches the lower value, and outputting an emergency stop signal if the transport speed exceeds the upper value.

In accordance with an added mode of the invention, the washcloth is transported by a motor driving one of said drums, and the method further comprises monitoring a torque of the motor, and outputting the end-of-washcloth signal only when an increase in torque of the motor is ascertained.

In accordance with an additional mode of the invention, the supply drum and the takeup drum are disposed in a washing insert which is removably mounted in the printing press and, when the washing insert is mounted in the printing press, the drums are driven by a single motor disposed on the printing press, and the method comprises:

in the winding step, rotating the motor in one direction of rotation for driving the supply drum and rotating the motor in the other direction of rotation for driving the takeup drum, and, in the outputting steps, if no transport distance signals are received from the sensor device as a result of the winding step, outputting a signal indicating that no washing insert is mounted in the printing press.

In accordance with another mode of the invention, the method further comprises guiding the washcloth in the washing insert over a rotatably supported indexing shaft in the winding step and during the ongoing washing operation, thereby rotating the indexing shaft proportionally to the transport speed of the washcloth, and determining the transport speed by scanning the rotation of the indexing shaft with the sensor device.

In accordance with a further mode of the invention, the indexing shaft is formed with markings, and the method comprises scanning the markings with the sensor device in a contactless fashion and issuing pulse signals with the sensor device indicating rotation of the indexing shaft. In the alternative, the indexing shaft carries an indexing wheel, and the method further comprises scanning the indexing wheel with the sensor device in the winding and determining steps.

With the above and other objects in view there is also provided a washing system for a printing press, wherein the washing system includes a washcloth supply drum and a washcloth takeup drum, and a washcloth which is wound forward and back between the supply and takeup drums, and at least one motor for driving the supply and takeup drums, an apparatus for controlling a washing operation in a printing press, comprising:

a sensor device monitoring a movement of the washcloth and issuing a signal proportional to a transport distance of the washcloth;

a washing program control connected to the at least one motor and to the sensor device, the washing program control including a device for monitoring a functional readiness of the washing system and a transport speed monitoring device for monitoring a transport speed of the washcloth, the transport speed monitoring device being connected to and receiving signals from the sensor device, a display device connected to the washing program control, and an emergency stop device of the printing press.

In accordance with again an added feature of the invention, the transport speed monitoring device is further connected to the at least one motor for monitoring a torque thereof.

In accordance with again an additional feature of the invention, the washing system is a washing insert removably mounted in the printing press, and the at least one motor is a single motor disposed on the printing press, the at least one motor, when the washing insert is inserted in the printing press, selectively driving the supply drum and the takeup drum depending on a rotational direction thereof.

In accordance with a concomitant feature of the invention, the sensor device includes an indexing shaft rotatably supported in the washing insert, the indexing shaft being rotated as the washcloth rolls thereon under tension between the supply and takeup drums, an indexing wheel with markings connected to the shaft, and a sensor secured on the printing press and, when the washing insert is inserted in the printing press, is aimed at the markings of the indexing wheel.

In other words, the objects of the invention are achieved in that before the beginning of the washing operation, the washcloth is wound forward and back again by some distance and as a function of whether transport distance signals are obtained in the process, a ready signal or not-ready signal is output, and in that during the ongoing wash cycles a standard for the transport speed is derived from the transport distance signal. That signal is continuously compared with a predetermined lower value and a predetermined upper value. An end-of-washcloth signal is output in the event that the transport speed reaches the lower value, and an emergency stop signal is output if the transport speed exceeds the upper value.

The apparatus of the invention is integrated into a system for controlling the washing operation in a printing press. The printing press has a washing system with a washcloth that can be wound forward and back between two rotatable drums, at least one motor for driving the drums, a sensor device for the transport distance of the washcloth, and a washing program control means that is connected to the motor or motors and to the sensor device. The object of the invention is solved in accordance with the invention by means of a device for monitoring the functional readiness of the washing system, which device is connected to the motor or motors and to the sensor device, and by means of a device for monitoring the transport speed of the washcloth. That device is connected to the sensor device, a display device, and an emergency stop device of the printing press.

It is thus possible in a simple way, by changing the control electronics or the control program, to utilize the sensor device of the known transport distance control for three further functions, namely a ready control (with a readiness query), an end-of-washcloth shutoff, and an emergency stop function in the event that the washcloth is pulled into the printing mechanism.

With the end-of-washcloth shutoff according to the invention, all the washcloth rolls inserted are utilized to the very end. The end of the washcloth roll is detected particularly reliably if not only the transport speed of the washcloth but also the torque of a motor for the drum drive is monitored, for instance by monitoring the motor current, and if the end-of-washcloth signal is output only whenever an increase in the torque of the motor that is involved in the reduction of the transport speed is ascertained.

The readiness control is especially expedient if the aforementioned replaceable washing insert is used, in which the drums are disposed. With the washing insert inserted, the drums can be driven with a single motor, which is disposed on the printing press and which, depending on its direction of rotation, rotates either the one drum or the other. Such a system is known from the above-mentioned EP 0 520 521 A1. Because the motor upon initialization of the printing press is rotated forward and back by some distance, in the course of which it is checked whether corresponding transport distance signals are received, it is possible in a simple manner according to the invention to check whether a washing insert is present.

The emergency stop function is significant for a—not entirely impossible—situation in which the washcloth is pulled into the machinery as a result of breaks or defects in the stopped drive train. With the invention, the onset of such an eventuality is detected quickly enough to reliably avoid damage to the cylinders.

As already noted, the use of the invention in the known washing device requires no changes whatever in its mechanical construction but rather in the washing program and the control electronics for that program. If control electronics that include the washing program control, the device for monitoring the functional readiness of the washing device and the device for monitoring the transport speed of the washcloth are used, then these devices can be embodied not merely as modular electronics but rather combined in some arbitrary way, or shifted for performing partial tasks.

A standard for the transport speed of the washcloth is formed in a particularly simple manner as it is derived from the frequency of signals from regularly disposed markings formed on the sensor device.

Other features which are considered as characteristic for the invention are set forth in the appended claims. Although the invention is illustrated and described herein as embodied in a method and apparatus for controlling the washing operation in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
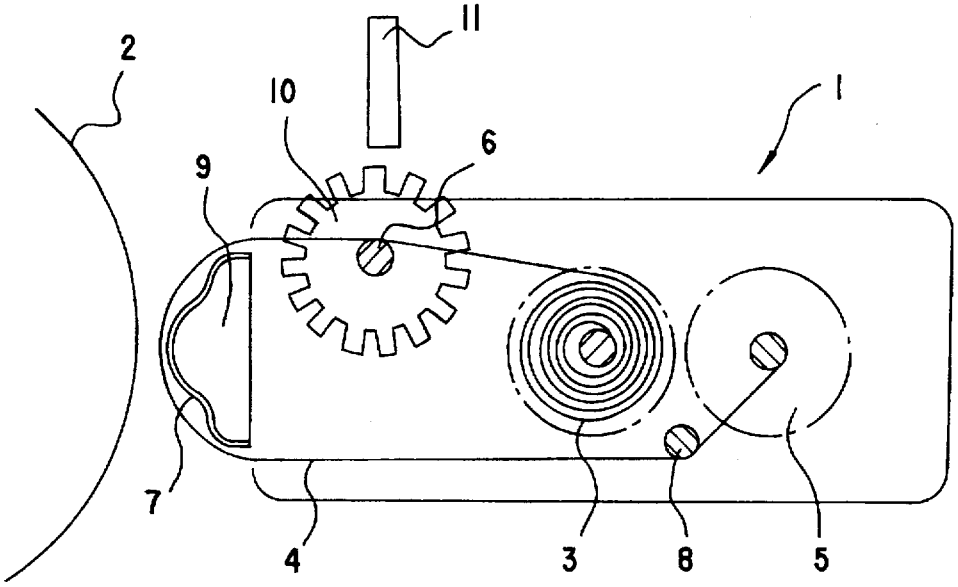
FIG. 1 is a schematic sectional view of a washing insert disposed in a printing press.

Referring now to the figures of the drawing and first, particularly, to FIG. 1 thereof, a washing insert 1 is strategically located in a printing press. Only one cylinder 2 is shown, which by way of example is the rubber blanket cylinder of the printing press. The washing insert 1 includes a supply drum 3, on which a length of fresh washcloth 4 is wound up, and a takeup drum 5, to which one end of the washcloth 4 is secured and onto which the washcloth 4 is gradually wound. Along the way from the supply drum 3 to the takeup drum 5, the washcloth 4 is guided via a freely rotatable indexing shaft 6, a rubber cushion 7, and a deflecting guide shaft 8. The rubber cushion 7 can be inflated, from a cavity 9 located beneath it, in the direction of the cylinder 2 by means of compressed air so as to press the washcloth 4 against the surface of the cylinder 2 for each washing operation.

Figure 2:
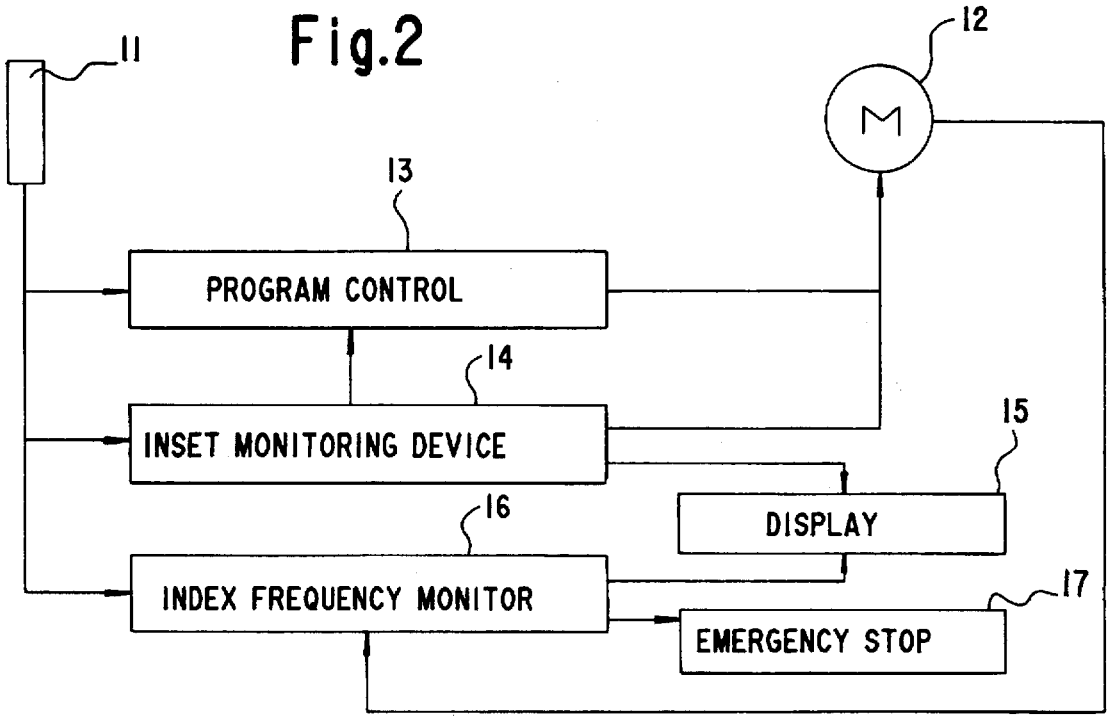
FIG. 2 is a basic layout diagram of a circuit for controlling the washing operation and for performing further functions in the configuration of FIG. 1.

The drums 3, 5 are connected on one axial end to a non-illustrated coupling and transmission device, which when the washing insert 1 is inserted into the printing press is in communication with an electric motor 12 built into the printing press (cf. FIG. 2). More detailed information regarding washing inserts of this kind may be found in copending application Ser. No. 08/228,683, which is herewith incorporated by reference.

A toothed indexing wheel 10 is seated on one axial end of the indexing shaft 6, which is rotatable in the respective transport direction by the washcloth 4 deployed over it whenever the washcloth 4 is wound forward or back. The indexing wheel 10 thus has markings on its circumference. With the washing insert 1 inserted, a sensor 11 secured to the printing press is aimed at the teeth or markings of the index wheel 10.

The washing insert 1 described above functions as follows:

In each washing cycle, the washcloth 4 is gradually transported some distance forward as a result of the fact that the takeup drum 5 is driven, and is transported backward by a shorter distance between each two washing cycles so that the less-soiled portions of the washcloth can be reused; this is done by driving the supply drum 3 in the opposite direction from the takeup drum 5. The switchover is effected via the aforementioned coupling and transmission device by means of a reversal of the direction of rotation of the electric motor 12. During washcloth transport, the sensor 11 receives distance-proportional (washcloth length-proportional) pulses from the toothed index wheel 10. These pulses are supplied to and processed in a washing program control 13, which controls the electric motor 12, so as to keep the respective transport distances constant.

When the printing press is initialized as it is turned on or restarted, the electric motor 12 is briefly rotated in the forward direction and backwards by an insert monitoring device 14. If the washing insert 1 has been inserted, the washcloth 4 is moved forward and back by some detectable distance. The forward and backward motion can also be utilized in order to ascertain, before each wash cycle, whether the requisite amount of unused washcloth is still present. To that end, the washcloth is moved forward and back by the distance required for one wash cycle. If during the rotation forward and back again the sensor furnishes signals twice, then the insert monitoring device 14 enables the washing program control means 13. Otherwise, a display is provided on the control panel display 15 that indicates the absence of a washing insert 1. In a most simple embodiment, the insert monitoring device 14 may be a toggle switch, such as a microswitch 14 which is mechanically responsive to whether or not the washing insert is inserted in the printing press.

During ongoing washing cycles, the pulses of the sensor 11 are also supplied to an index frequency monitor 16, which calculates the frequency of the pulses and checks them for adherence to upper and lower preset limits.

The lower limit has the function of ascertaining a stoppage of the washcloth 4 resulting from the fact that a roll on the supply drum 3 has been used up. If the index frequency during the wash cycle reaches the lower limit, which is selected to be in the vicinity of zero or equal to zero, then an end-of-washcloth signal is output. The washing program is automatically terminated upon the issuance of the end-of-washcloth signal, and a display is shown in the control panel display 15 to indicate that the washcloth roll has been used up and must be changed.

To avoid any possible incorrect display caused by a temporary stoppage of the washcloth 4 for other reasons, the current of the electric motor 12 is sampled by the index frequency monitor 16 along with the index frequency; this current rises relatively suddenly if the end of the washcloth is reached.

Finally, the upper limit of the index frequency has the function of finding out as soon as possible if the washcloth 4 has been pulled into the printing press cylinders—which rotate rapidly relative to the speed of the washcloth transport—so that the printing press can be slowed down soon enough to prevent damage to the cylinders from the washcloth which has been caught therebetween.

For carrying out this emergency stop function, the index frequency of the sensor 11 is permanently compared with a maximum allowable index frequency, which is selected in accordance with the technically possible transport speed of the washcloth 4, plus an additional margin for safety. If the maximum allowable index frequency is exceeded, the index frequency monitor 16 activates an emergency off switch 17 of the printing press. It has been demonstrated that it possible in this way to slow down the printing press quickly enough to effectively prevent cylinder damage, both at the usual washing speeds and even far above them.

Figure 3:
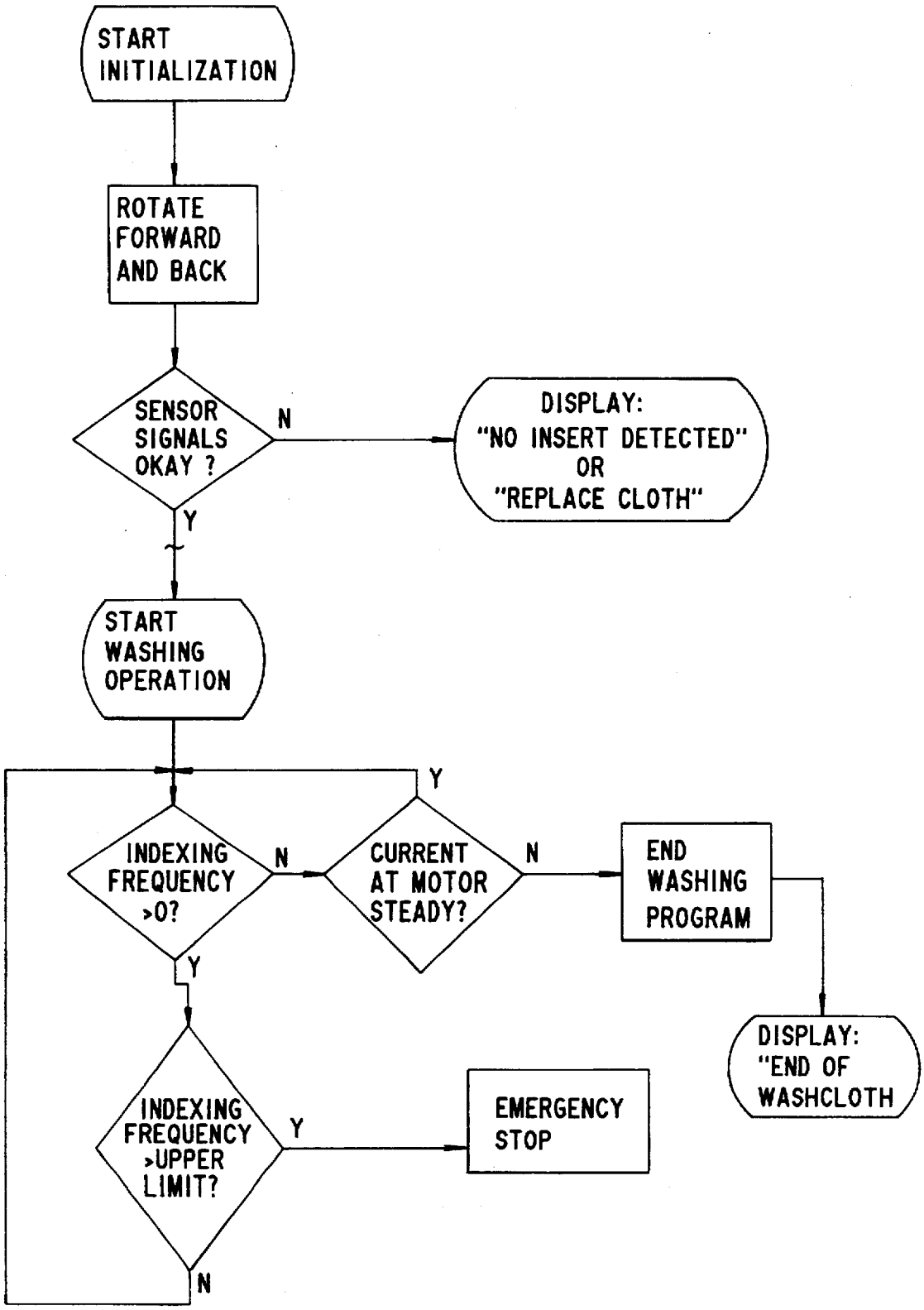
FIG. 3 is a basic flow chart of a program running the washing operation.

With reference to FIG. 3, a program loop would be divided into initialization and main program portions. The first step of the initialization is to rotate the motor 12 forward and backward so as to enable a query at the sensor. If two signals are received, the initialization is successful and the main program may be released. Depending on the set distance of forward and backward rotation, the display may only indicate whether or not the insert is present or even whether or not there is enough cloth for at least one washing operation.

After the washing operation has been started, the sensor signal (the indexing frequency) is continually compared with the lower limit (e.g. zero) and with the upper limit (fastest washcloth transport plus safety margin). As a backup, the program also queries the electromotor with regard to the current flowing therethrough. A forced stoppage, for instance, causes a sudden rise in the motor current.

The cooperating results of the sensor and the motor monitor are embodied in the following table. The first four columns I–IV require information regarding the motor, while the fifth column V is independent of the motor current:

| Motor current | I Current okay | II Current = 0 | III Current too high | IV Current okay | V |
|---|---|---|---|---|---|
| Sensor | no signal | no signal | no signal | signal okay | signal frequency too high |
| Result | no insert or washcloth torn or sensor defective or | motor or motor control defective | washcloth out | insert present washcloth okay | washcloth being pulled into press |
| | error | error | error exchange insert! | | emergency STOP |

EXAMPLE

Figure 4:
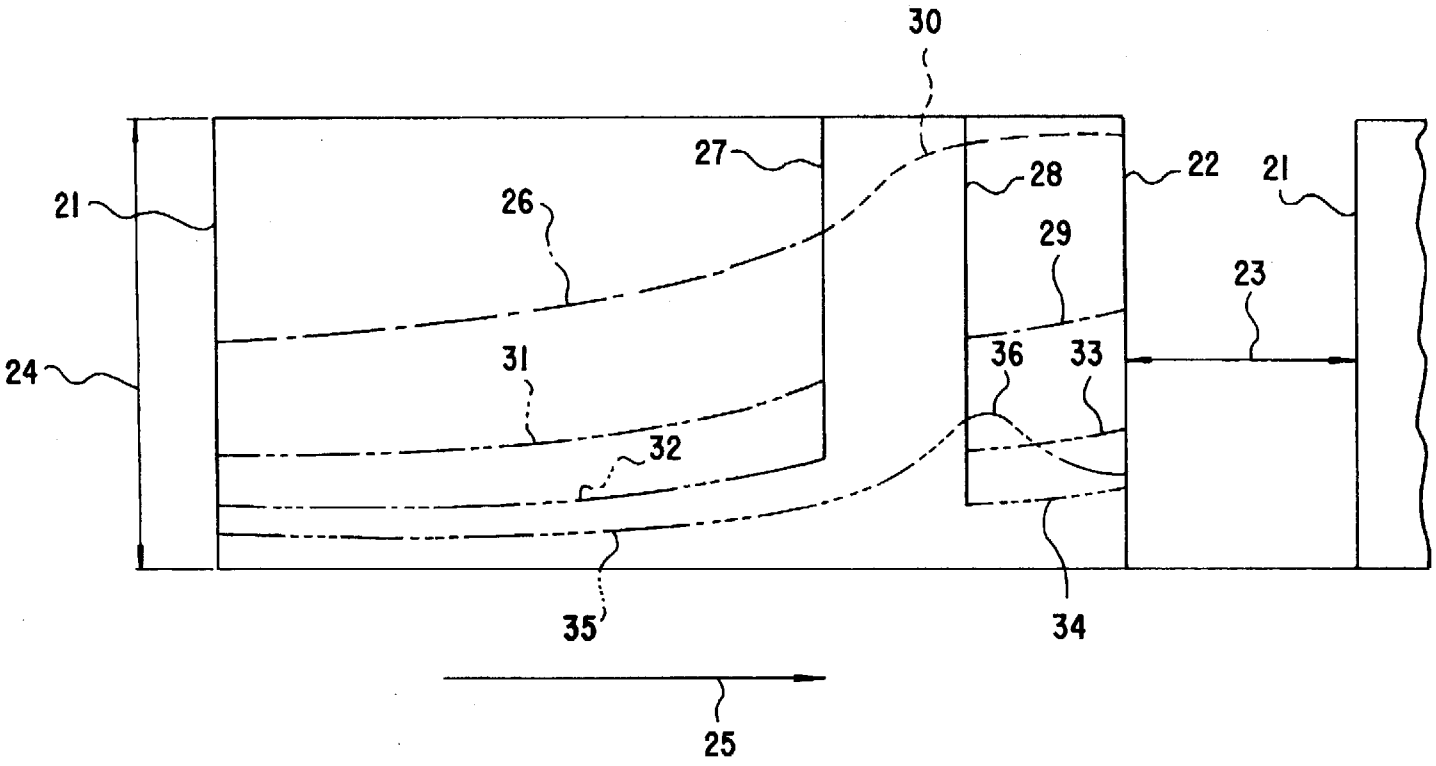
FIGS. 4–6 are developed views of a rubber blanket cylinder a corresponding cleaning curves.
Figure 5:
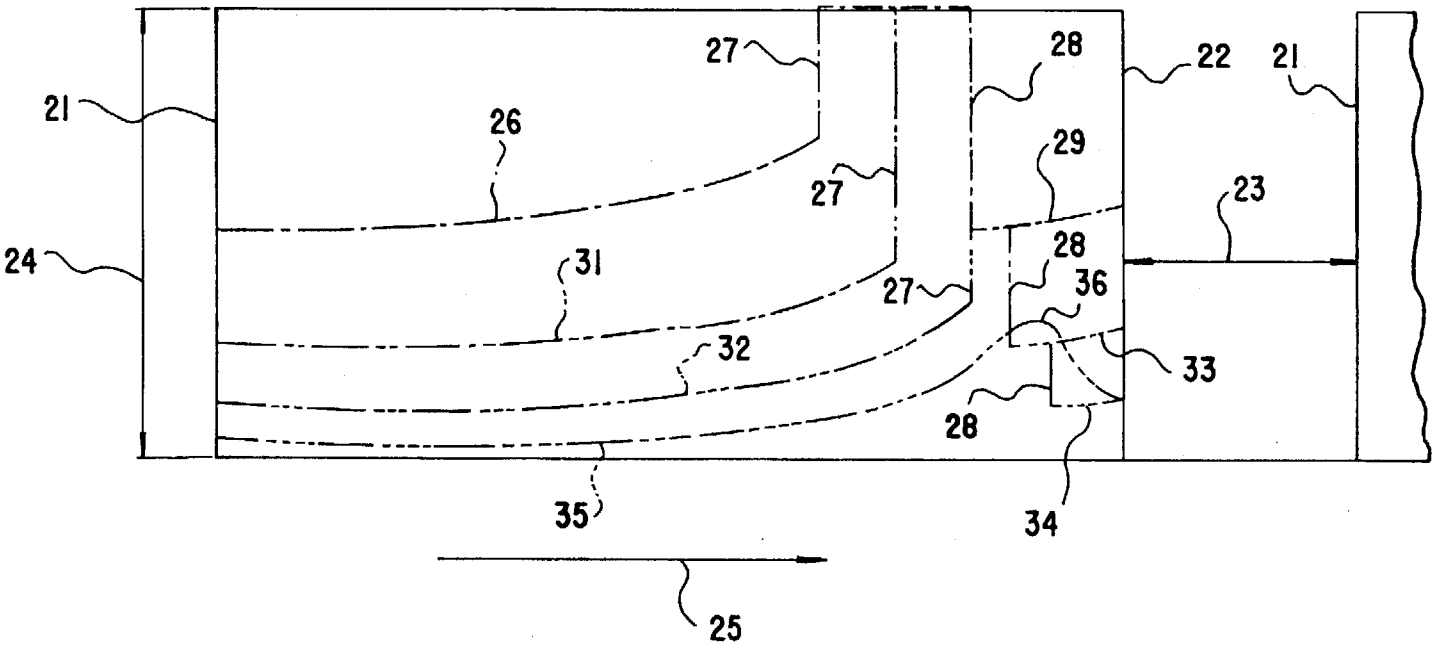
Figure 6:
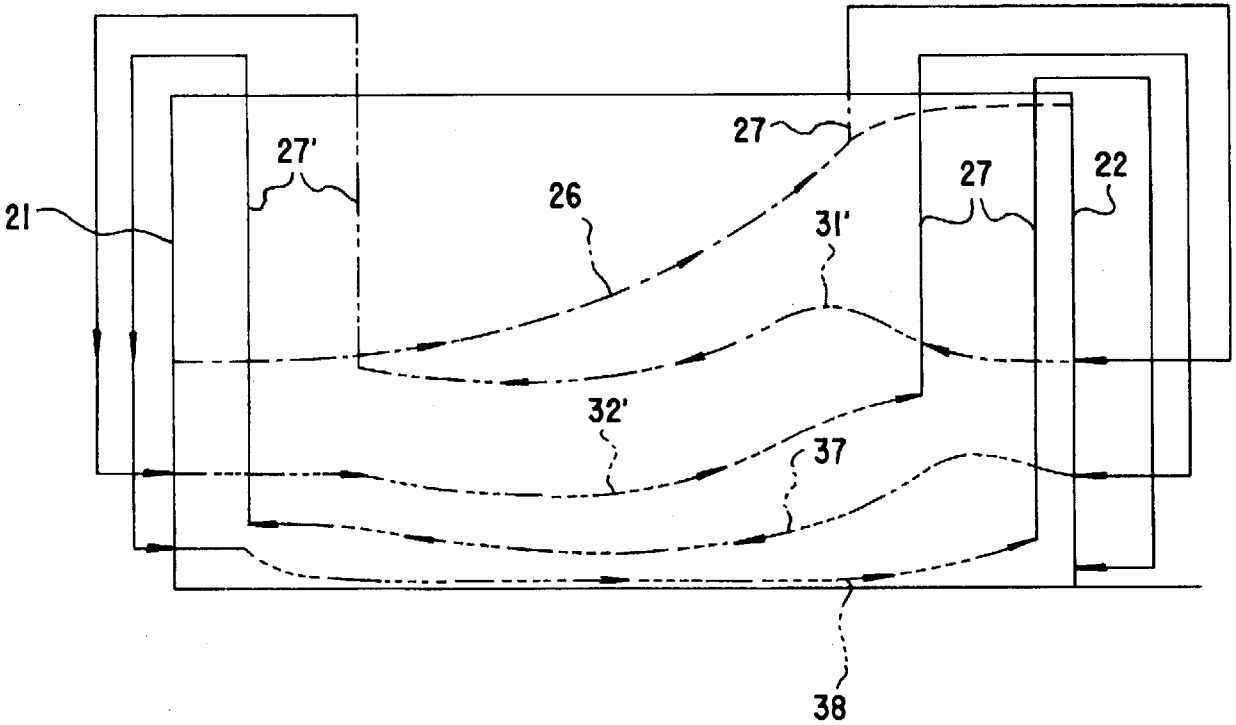

Referring now to FIGS. 4–6, an exemplary washing operation is explained with the developed views of a rubber blanket of a rubber-blanket cylinder with a cylinder gap. Viewed in the direction of rotation of the rubber-blanket cylinder, a cylinder gap 23 forms an intermediate space between start 21 and end 22 of the rubber blanket. The ink application 24 corresponds to the quantity of ink present at a given time on the rubber blanket. The direction of rotation 25 extends to the right in FIGS. 4 and 5 and corresponds to one clockwise revolution.

The first cleaning operation during one revolution of the rubber-blanket cylinder commences with the bringing-into-contact of a clean section of the cleaning cloth at the start 21 of the rubber blanket, the dissolved ink residues being removed according to the curve 26 (FIG. 4). The brief lifting-off 27 of the cleaning cloth from the rubber blanket serves to cycle the cleaning cloth further in order to create a clean section in the region of the wiping area. Immediately thereafter, the cleaning cloth is brought into contact again with the rubber blanket. After the bringing-into-contact 28 of the cleaning cloth, the last part-section of the rubber blanket is cleaned according to the curve 29. The broken line 30, in extension of the curve 26, shows how, in prior art washing processes, the soiling of the cleaning cloth reaches a maximum. The result is that, at the end, it is no longer possible for dirty cleaning fluid to be absorbed. After the end 22 of the rubber blanket, the cleaning cloth is again cycled further so that a clean section is available at the start 21.

The curves 31 and 32 show the next two cleaning operations, in which, likewise, the cleaning cloth is lifted off at 27 and brought down at 28. The curves 33 and 34 show the progress of cleaning after the cleaning cloth has been brought down. The final cleaning operation corresponds to the curve 35. In that case, the cleaning cloth remains in contact from the start 21 to the end 22 of the rubber blanket and the streak with dirty cleaning agent remaining between positions 27 and 28 is removed, the curve 35 rising to a maximum 36. The maximum 36, however, is considerably below the maximum absorption capacity of the cleaning cloth. Thereafter, there are no further sweeps of the cylinder.

FIG. 5 basically shows the same cleaning operation as in, FIG. 41, merely that, in this case, the times of lifting off 27 for the individual cleaning operations 26, 31 and 32 are slightly staggered, as also are the times of bringing back into contact 28. This reduces the size of the non-cleaned region during the first three cleaning operations 26, 31 and 32. Accordingly, the maximum 36 of the final cleaning operation according to curve 35 is lower.

In FIG. 6, the cleaning process has been modified such that the first cleaning operation takes place according to curve 26, with the lifting-off 27 of the cleaning cloth taking place in the last third of the rubber blanket. In this embodiment, however, the cleaning cloth is cycled further and is thereafter not brought down again onto the rubber blanket. In this embodiment, after the end 22 of the rubber blanket, the direction of rotation of the rubber-blanket cylinder is reversed through the intermediary of the printing-press drive and the second cleaning operation takes place likewise with a clean section of cleaning cloth at the end 22 and progresses according to curve 31'. Just before the end of the cleaning operation 31' at the start 21 of the rubber blanket, the cleaning cloth is likewise lifted off at 27'. Here too, the cleaning cloth is then cycled further and, after the direction of rotation of the rubber-blanket cylinder has been reversed, is brought down again at the start 21 according to curve 32'. It is advantageous in this case for the lifting-off 27 to be slightly staggered in time, as represented in FIG. 6. Thereafter, the cleaning cloth is again cycled further and the next cleaning operation takes place according to curve 37. Here too, the lifting-off 27' is staggered in time, with the result that a further cleaning operation can be performed according to curve 38. After the cylinder has been reversed and a clean section of cleaning cloth has been brought into contact, a final cleaning operation is performed opposite to the normal direction of rotation of the printing press, said final cleaning operation leaving the rubber blanket clean. Thereafter, it is merely necessary for the direction of rotation of the printing press and thus of the rubber blanket cylinder to be reversed into the normal running direction of the printing press.

It is also possible for other cylinders, such as the impression cylinder, of a rotary offset printing press to be washed in the aforedescribed manner.

We claim:

1. A method for controlling a washing operation in a printing press, wherein a washcloth is selectively wound forward and backward between a rotatable supply drum and a rotatable takeup drum, the washcloth is cyclically pressed against a surface of a cylinder of the printing press in the washing operation and is transported onward onto the takeup drum, the method which comprises:

detecting, with a sensor device, a transport distance of the washcloth device and furnishing, with the sensor, a transport distance signal;

in an initialization before a beginning of the washing operation:

winding the washcloth forward and back by a given distance, and selectively outputting a ready signal if transport distance signals have been received from the sensor device or outputting a not-ready signal if transport distance signals have not been received from the sensor device as a result of the winding step; and in an ongoing washing operation:

continuously determining a transport speed of the washcloth from the transport distance signal;

continuously comparing the transport speed with a predetermined lower value and a predetermined upper value; and outputting an end-of-washcloth signal if the transport speed reaches the lower value, and outputting an emergency stop signal if the transport speed exceeds the upper value.

2. The method according to claim 1, wherein the washcloth is transported by a motor driving one of said drums, and the method further comprises monitoring a torque of the motor, and outputting the end-of-washcloth signal only when an increase in torque of the motor is ascertained.

3. The method according to claim 1, wherein the supply drum and the takeup drum are disposed in a washing insert which is removably mounted in the printing press and, when the washing insert is mounted in the printing press, the drums are driven by a single motor disposed on the printing press, and the method comprises:

in the winding step, rotating the motor in one direction of rotation for driving the supply drum and rotating the motor in the other direction of rotation for driving the takeup drum, and, in the outputting steps, if no transport distance signals are received from the sensor device as a result of the winding step, outputting a signal indicating that no washing insert is mounted in the printing press.

4. The method according to claim 3, which comprises guiding the washcloth in the washing insert over a rotatably supported indexing shaft in the winding step and during the ongoing washing operation, thereby rotating the indexing shaft proportionally to the transport speed of the washcloth, and determining the transport speed by scanning the rotation of the indexing shaft with the sensor device.

5. The method according to claim 4, whereby the indexing shaft is formed with markings, and the method comprises scanning the markings with the sensor device in a contactless fashion and issuing pulse signals with the sensor device indicating rotation of the indexing shaft.

6. The method according to claim 4, whereby the indexing shaft carries an indexing wheel, and the method further comprises scanning the indexing wheel with the sensor device in the winding and determining steps.

7. In combination with a washing system for a printing press, wherein the washing system includes a washcloth supply drum and a washcloth takeup drum, and a washcloth which is wound forward and back between the supply and takeup drums, and at least one motor for driving the supply and takeup drums, an apparatus for controlling a washing operation in a printing press, comprising:

a sensor device monitoring a movement of the washcloth and issuing a signal proportional to a transport distance of the washcloth;

a washing program control connected to the at least one motor and to said sensor device, said washing program control including a device for monitoring a functional readiness of the washing system and a transport speed monitoring device for monitoring a transport speed of the washcloth, said transport speed monitoring device being connected to and receiving signals from said sensor device, a display device connected to said washing program control, and an emergency stop device of the printing press.

8. The apparatus according to claim 7, wherein said transport speed monitoring device is further connected to the at least one motor for monitoring a torque thereof.

9. The apparatus according to claim 7, wherein the washing system is a washing insert removably mounted in the printing press, and the at least one motor is a single motor disposed on the printing press, the at least one motor, when the washing insert is inserted in the printing press, selectively driving the supply drum and the takeup drum depending on a rotational direction thereof.

10. The apparatus according to claim 9, wherein said sensor device includes an indexing shaft rotatably supported in the washing insert, said indexing shaft being rotated as the washcloth rolls thereon under tension between the supply and takeup drums, an indexing wheel with markings connected to said shaft, and said sensor is secured on the printing press and, when the washing insert is inserted in the printing press, is aimed at said markings of said indexing wheel.

* * * * *